US007051508B2

(12) United States Patent
Stahlecker et al.

(10) Patent No.: US 7,051,508 B2
(45) Date of Patent: May 30, 2006

(54) YARN WITHDRAWAL DEVICE FOR OPEN-END SPINNING ARRANGEMENTS AND METHOD OF MAKING YARN USING SAME

(75) Inventors: Gerd Stahlecker, Eislingen/Fils (DE); Guenter Baur, Suessen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 10/873,162

(22) Filed: Jun. 23, 2004

(65) Prior Publication Data

US 2004/0255569 A1 Dec. 23, 2004

(30) Foreign Application Priority Data

Jun. 23, 2003 (DE) ..... 103 29 612

(51) Int. Cl.
*D01H 4/08* (2006.01)

(52) U.S. Cl. ..... 57/404; 57/417

(58) Field of Classification Search ..... 57/404–417
See application file for complete search history.

(56) References Cited

U.S. PATENT DOCUMENTS 4,516,397 A 5/1985 Raasch et al.
4,773,211 A * 9/1988 Stahlecker et al. ..... 57/417
4,796,421 A * 1/1989 Stahlecker et al. ..... 57/417
4,843,812 A * 7/1989 Raasch ..... 57/417
4,854,119 A * 8/1989 Stahlecker et al. ..... 57/417
5,044,151 A * 9/1991 Pohn et al. ..... 57/417
5,321,943 A * 6/1994 Schmid et al. ..... 57/417
6,035,625 A 3/2000 Schloemer et al.

FOREIGN PATENT DOCUMENTS

DE 32 20 402 3/1985
DE 34 19 300 1/1987
DE 197 38 382 3/1999

* cited by examiner

*Primary Examiner*—Shaun R. Hurley
(74) *Attorney, Agent, or Firm*—Crowell & Moring LLP

(57) ABSTRACT

A yarn withdrawal device for open-end spinning arrangements has a yarn withdrawal nozzle and a balloon-breaking insert which extends the axial channel of the yarn withdrawal nozzle. The yarn withdrawal nozzle has a curved contact surface for deflecting a yarn to be withdrawn and simultaneously rotating the yarn in a crank-like manner, which contact surface graduates from a front surface into the axial channel. The balloon-breaking insert has an inner wall which is provided with raised areas and/or recesses, with which the yarn comes into contact. The contact surface of the yarn withdrawal nozzle is a smooth steel surface. The raised areas and/or the recesses of the balloon breaking insert are such that a yarn hairiness in the range of 3 mm in length is achievable. In addition, values in relation to the spinning stability, tear resistance and evenness can be achieved which are usual in the case of a notched contact surface of standard yarn withdrawal nozzles without a balloon-breaking insert.

24 Claims, 2 Drawing Sheets

YARN WITHDRAWAL DEVICE FOR OPEN-END SPINNING ARRANGEMENTS AND METHOD OF MAKING YARN USING SAME

BACKGROUND AND SUMMARY OF THE INVENTION

This application claims the priority of German Application No.: 103 29 612.3 filed on Jun. 23, 2003, the disclosure of which is expressly incorporated by reference herein.

The present invention relates to a yarn withdrawal device for open-end spinning arrangements, comprising a yarn withdrawal nozzle, which contains a curved contact surface for guiding yarn which is to be withdrawn and which yarn simultaneously rotates in a crank-like manner, said contact surface graduating from a front surface into an axial channel, also comprising a balloon-breaking insert which extends the axial channel, the inner wall of the balloon-breaking insert being provided with raised areas/and or recesses with which the yarn comes into contact.

In open-end spinning, yarn withdrawal devices comprising yarn withdrawal nozzles in a great variety of embodiments are prior art. A plurality of such known yarn withdrawal nozzles, together with their advantages and disadvantages are described in German published patent application 197 38 382 (corresponding U.S. Pat. No. 6,035,625).

In the above mentioned publication it is disclosed that yarn withdrawal nozzles having smooth contact surfaces produce good quality yarn, but that yarn withdrawal nozzles of this type permit only a relatively low level of spinning stability, as the initial torsion upstream of the contact surface is too low due to the smoothness of the contact surface. Smooth yarn withdrawal nozzles are therefore particularly subject to end breaks.

The known publication describes further that so-called notch nozzles, that is, such yarn withdrawal nozzles whose contact surfaces are provided with notches or ribs increase the spinning stability, that is, they reduce the number of end breaks. This, however, is at the cost of the yarn quality, namely the tear resistance and the evenness of the spun yarn. Despite this, notched nozzles of this type have proven to be a good compromise and serve as the standard design in many applications.

It is further known from the publication that the notches can be present not only in the contact surface, but also in the annexing axial channel. This increases further the spinning stability, but at the cost of further reduced yarn quality. Notches and/or ribs in the axial channel ensure, however, a certain degree of hairiness of the spun yarn, which results in a "softer feel" which is often the intention.

The known publication further mentions that the so-called spiral nozzles are known in which the notches and/or ribs extend in the manner of a helix, and thus ensure a somewhat greater spinning stability than the smooth yarn withdrawal nozzles. The spinning stability is however less than in the case of such yarn withdrawal nozzles, in which the contact surface is notched. Spiral nozzles have, however, a relatively good yarn quality. The above mentioned publication further discloses that the spiral can project into the axial channel.

Also known from the above mentioned publication is a combination of notches and spirals, whereby serviceable yarn quality values with good spinning stability are assumed.

As the yarn withdrawal nozzles deflect the withdrawn yarn at approximately 90°, the yarn runs crank-like on the front surface of the yarn withdrawal nozzles at high speed. This results in that in the axial channel of the yarn withdrawal nozzle a certain balloon formation of the withdrawn yarn takes place. This has been taken advantage of in that so-called balloon-breaking inserts are arranged downstream, which are known in the industry as "whirl inserts". A balloon-breaking insert of this kind is prior art in German published patent 32 20 402 (corresponding U.S. Pat. No. 4,516,397). This balloon-breaking inserts are especially then applied when it is intended that the spun yarn should have an increased hairiness. The surface structure of the spun yarn is changed by the balloon-breaking insert in that the yarn is roughened. This is basically fiber damage, so that the greater hairiness is gained with an inevitable reduction in tear resistance and evenness of the yarn. Such balloon-breaking inserts are basically spinning components which treat the yarns very roughly.

It is further known from German published patent 34 19 300 that the effect of such balloon-breaking inserts can be decreased by means of suitable ball-shaped inserts, whereby, depending on the design of the inserts, yarns with more or less hairiness can be spun. This publication discloses also that in addition the twist propagation, that is the spinning stability, can be influenced. The balloon-braking insert disclosed in this publication can be combined as required with yarn withdrawal nozzles having contact surfaces either with or without notches.

It is an aim of the present invention, based on the latter named publication, to pursue the further design of these undoubtedly correctly designed devices. One aim in particular is to spin yarn with a certain, but not too great, degree of hairiness, while at the same time, however, achieving good yarn values and good spinning stability.

This aim has been achieved in accordance with the present invention in that, in the case of a yarn withdrawal device of the above mentioned type, the contact surface of the yarn withdrawal nozzle is a smooth steel surface, and that the inner wall of the balloon-breaking device is provided with blunted raised areas/and or recesses reduced in such a way that a hairiness in the range of 3 mm in length can be achieved, while at the same time achieving values for spinning stability, wear resistance and evenness that are comparable to those resulting from notched contact surfaces of standard yarn withdrawal nozzles without balloon-breaking inserts.

The yarn withdrawal nozzle according to the present invention comprises firstly the advantage of a smooth contact surface, that is, without notches or ribs, which is responsible for a good yarn quality. A smooth contact surface of this type ensures yarn-friendly treatment of the withdrawn yarn in the particularly critical area. The steel surface permits sufficient hardness and thus wear-resistance of the contact surface, while at the same time ensuring a good carrying-off of heat, which is required in particular when spinning polyester fibers. The blunted balloon-breaking insert arranged downstream delivers the desired level of hairiness without too high a level of fiber damage. By means of simple tests, the right combination of a smooth yarn withdrawal nozzle with a suitable balloon-breaking insert can be found, whereby yarn quality and spinning stability values are achieved which are comparable to the notched yarn withdrawal nozzles without balloon-breaking inserts. The characteristics of the contact surface of a standard yarn withdrawal nozzle are thus transferred to a great extent to the balloon-breaking insert, which is present only for the purposes of achieving a certain pre-defined hairiness, while the contact surface of the yarn withdrawal nozzle itself is designed with regard to good yarn quality. The combination of a smooth yarn withdrawal nozzle comprising a contact surface of steel and having a reduced-effect balloon-breaking insert permits, by way of its flexibility, an even more specific adaptation of the yarn withdrawal device to the respective application than was previously possible.

It should be mentioned at this point that notched contact surfaces made of steel wear relatively quickly, as the notch forms are eroded so that spinning stability is no longer ensured after a short time. Contact surfaces of yarn withdrawal nozzles were therefore made of ceramic material as standard, which is less favorable with regard to heat elimination. In the case of the yarn withdrawal device of the present invention, it is in contrast now possible not only to make the contact surfaces from steel, but also to allocate the wear-prone part to the balloon-breaking insert, which part can then consist, at least on its inner wall, of a ceramic material.

In an embodiment of the present invention, a diameter contraction is provided between the axial channel of the yarn withdrawal nozzle and the balloon-breaking insert. The contraction causes the withdrawn yarn to be guided more in the center of the balloon-breaking insert so that the raised areas and/or recesses have a less aggressive effect. The contraction thus serves to blunt the effect of the balloon-breaking insert and can be achieved in a simple way in that the contracted part is placed in a separate intermediary ring. This has the additional advantage in that standard whirl inserts, which are actually aggressive, can be applied, the effects of which are blunted in the required way by means of this intermediary ring.

In a further embodiment of the present invention it can be provided that downstream of the balloon-breaking insert a centering device for permitting a centrical yarn withdrawal is provided. A centering device of this type also serves to blunt the effect of the raised areas and/or the recesses of the balloon-breaking insert. The centering device can in this case also be formed by means of a contraction, which in turn can be provided in a separate centering ring. The centering device can alternatively be formed by means of a yarn deflecting wall of a yarn withdrawal channel.

Many various embodiments can be chosen for the raised areas and/or recesses of the balloon-breaking insert. Ribs or notches can be provided which are arranged symmetrically or asymmetrically and if required, also helically, possibly extending in multiple helixes.

A particular advantage of the yarn withdrawal device of the present invention is then to be achieved when the yarn withdrawal nozzle and/or the balloon-breaking insert is designed as a replacement part. The most suitable yarn withdrawal device can be chosen and assembled for practically every desired yarn type.

These and further objects, features and advantages of the present invention will become more readily apparent from the following detailed description thereof when taken in conjunction with the accompanying drawings.

DETAILED DESCRIPTION OF THE DRAWINGS

Figure 1:
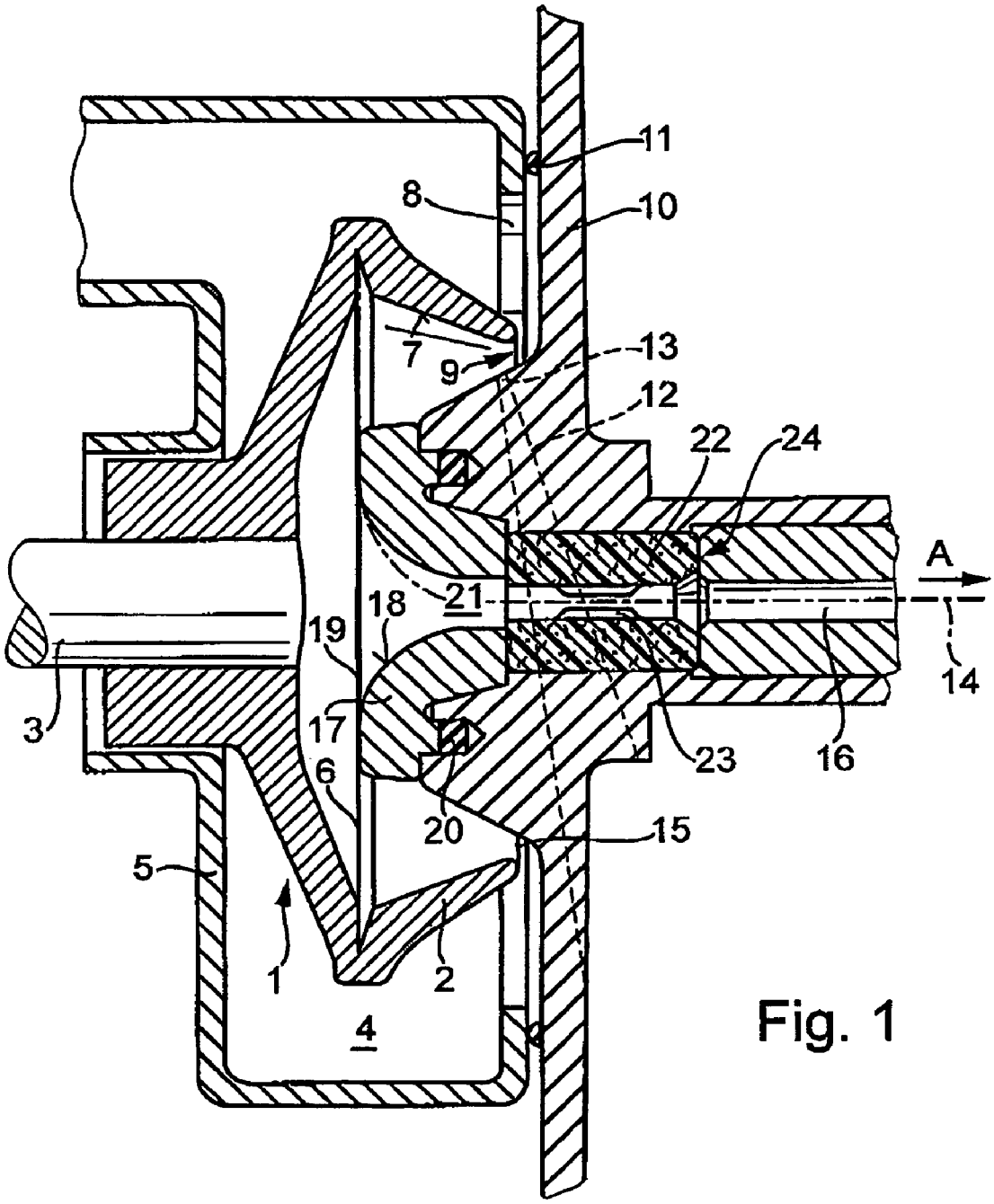
FIG. 1 is in enlarged form an axial section view through a part of an open-end spinning arrangement in the area of a yarn withdrawal device constructed according to the preferred embodiments of the present invention.

The partly shown open-end spinning device in FIG. 1 comprises a spinning rotor 1, which comprises a rotor cup 2 and a shaft 3 pressed therein. The shaft 3 is supported and driven in ways not shown. The rotor cup 2 rotates during operation in a low pressure chamber 4, which is formed by a rotor housing 5, which is connected to a vacuum source in a way not shown.

The rotor cup 2 comprises a fiber sliding surface 7 which widens conically towards a fiber collecting groove 6. The hollow interior of the rotor cup 2 has its largest diameter in the fiber collecting groove 6. The spinning rotor 1 can be removed through a front opening 8 of the rotor housing 5 towards the operator's side of the open-end spinning device. During operation, the opening 8 of the rotor housing 5, together with the open front side 9 of the rotor cup 2 is closed over by a movable cover 10. The movable cover 10 is disposed on the rotor housing 5 with a sealing ring 11 therebetween.

The cover 10 comprises a fiber feed channel 12, which lies outside of the plane of projection, which begins in a way not shown at an opening roller and whose mouth 13 is directed against the fiber sliding surface 7. Due to the effect of the above mentioned vacuum source, single fibers which have been combed out of a sliver by the opening roller are caused during operation to fly through the fiber feed channel 12 against the fiber sliding surface 7, from where they slide into the fiber collecting groove 6, form there a fiber ring and are then withdrawn in axial direction of the shaft 3 in the known way as yarn 14, denoted by a dot-dash line. The transport air sucked in via the fiber feed channel 12 can flow off via an overflow gap 15 on the open front side 9 of the spinning rotor 1.

The spun yarn 14 is withdrawn out of the fiber collecting groove 6 at least approximating a plane vertically to the shaft 3 of the spinning rotor 1 and subsequently via a yarn withdrawal channel 16 according to the delivery direction A by means of a delivery roller pair (not shown) and fed to a winding bobbin (also not shown). The yarn withdrawal channel 16 is disposed at least in its initial area coaxially to the shaft 3 of the spinning rotor 1, so that the yarn 14 leaving the fiber collecting groove 6 is initially deflected at an angle of approximately 90°, whereby the yarn 14 in the above mentioned vertical plane simultaneously rotates in a crank-like motion.

A yarn withdrawal nozzle 17 serves to deflect the yarn 14 from the above mentioned vertical plane into the yarn withdrawal channel 16, said yarn withdrawal nozzle 17 beginning with a funnel-shaped, curved contact surface 18 on a front surface 19 disposed in the vertical plane. In the axial section shown in FIG. 1, the contact surface 18 is a surface curved in the manner of an arc of a circle. The contact surface 18 forms in the shown axial section approximately a quarter circle having a radius of curvature measuring for example 3 mm. The yarn withdrawal nozzle 17 is held on the cover 10 by means of holding magnets 20.

It should be mentioned here that the speed of the crank-like rotation motion of the yarn 14 is very much greater than the speed of the yarn 14 in delivery direction A.

As can be seen in FIG. 1, the contact surface 18 of the yarn withdrawal nozzle 17 graduates into an axial channel 21. Due to the crank-like motion of the withdrawn yarn 14 at the front surface 19, the yarn 14 rotates in a balloon shape from the axial channel 21 onwards, whereby the yarn 14 may come to be disposed on the walls of the axial channel 21. This can be taken advantage of in that a balloon-breaking insert 22 can be arranged downsteam of the yarn withdrawal nozzle 17, the walls of which balloon-breaking insert 22 are designed in a particular way, for example with raised areas and/or recesses 23, with which the yarn 14 comes into contact due to the formation of the balloon. The yarn withdrawal nozzle 17, the balloon-breaking insert 22 as well as a yarn withdrawal channel 16 arranged downstream therefrom form together the essential component parts of a yarn withdrawal device 24.

In the past the aim was to achieve the good characteristics of the spun yarn 14 as well as spinning stability through the design of the yarn withdrawal nozzle 17, while hairiness, in as much as it was desired, could be effected by a balloon-breaking insert 22 arranged downstream. Now, according to the present invention, the effect of the raised areas and/or the recesses 23 of the balloon-breaking insert 22 is blunted, so that the achieved hairiness of the spun yarn 14 remains within reasonable limits, while yarn quality is achieved by means of a smooth steel surface of the contact surface 18. It has been hereby shown that it is possible solely by means of a combination of a smooth contact surface 18 made of steel and a blunted-effect balloon-breaking insert 22 arranged downstream thereof to spin yarns which, with regard to spinning stability, tear-resistance and evenness were only attainable until now by using standard notched yarn withdrawal nozzles without balloon-breaking inserts. Because of a contact surface 18 of the yarn withdrawal nozzle 17 designed as a smooth steel surface and an effect-blunted balloon-breaking insert 22, there is great flexibility with regard to the yarn withdrawal device 24, as the desired low level of hairiness together with sufficient spinning stability with good yarn qualities can be achieved. The balloon-breaking insert 22 is hereby advantageously made of ceramic material.

Figure 2:
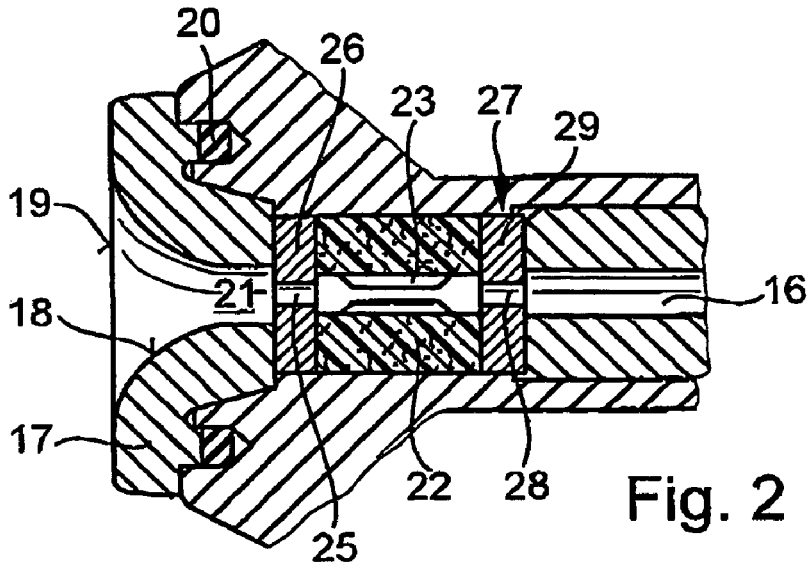
FIG. 2 is a partial view of FIG. 1 of a yarn withdrawal device, in which there is a diameter contraction upstream and downstream of the balloon-breaking insert.

It is additonally provided in FIG. 2, deviating from FIG. 1, that there is a diameter contraction 25 or 28 respectively upstream and downstream of the balloon-breaking insert 22. The first diameter contraction 25 is provided in an intermediary ring 26, which is located between the axial channel 21 of the yarn withdrawal nozzle 17 and the balloon-breaking insert 22. The second diameter contraction 28 is located directly downstream of the balloon-breaking insert 22 and is also provided in a ring-shaped component, here denoted as a centering ring 29. Only then does the actual yarn withdrawal channel 16 begin. The diameter contractions 25 and 28 blunt the effect of the raised areas and/or the recesses 23 of the balloon-breaking insert 22 and serve simultaneously the centering of the withdrawn yarn 14, in particular the second diameter contraction 28. The centering ring 29 is thus to a certain extent a centering device 27.

Figure 3:
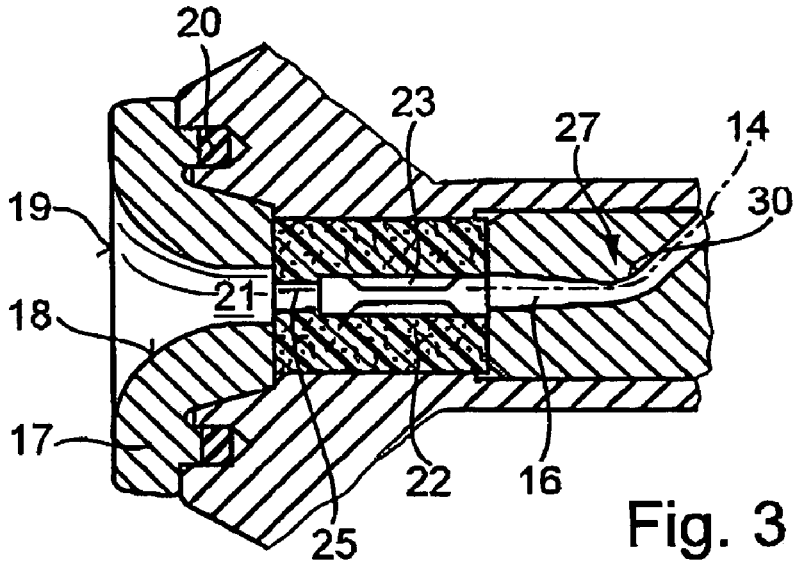
FIG. 3 is a view similar to FIG. 2 in which a yarn deflecting wall having the effect of a centering device is provided directly downstream of the balloon-breaking insert.

In the embodiment according to FIG. 3, the first diameter contraction 25 is not in a separate intermediate ring, but rather applied directly in the balloon-breaking insert 22. The centering device 27 located downstream, however, is here formed by a yarn deflecting wall 30 of the yarn withdrawal channel 16.

Figure 4:
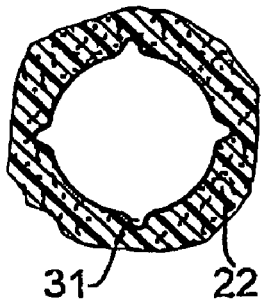
FIG. 4 is a cross section of a ballon-breaking insert, in contrast to the above Figures greatly enlarged, in which recesses in the form of notches are provided.
Figure 5:
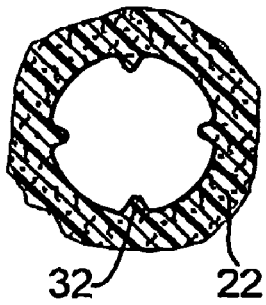
FIG. 5 is a cross section similar to FIG. 4, in which raised areas are provided in the form of ribs.
Figure 6:
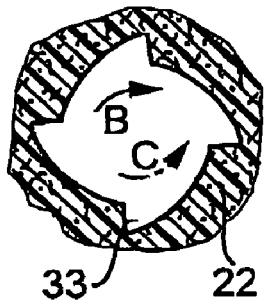
FIG. 6 is a cross section similar to FIGS. 4 and 5 having asymmetrically formed notches.

With the aid of FIGS. 4,5 and 6 it can be seen that the raised areas and/or the recesses 23 are designed in many different embodiments. According to FIG. 4, notches are provided as recesses 31, according to FIG. 5 ribs 32 are provided as raised areas. FIG. 6 further shows that also asymmetrical notches 33—in the same way asymmetrical ribs (not shown)—can be applied, which can give the balloon-breaking insert 22 particular desired characteristics. Depending on the rotational direction B or C of the withdrawn yarn 14, it is possible to achieve various characteristics and outward finishes for the spun yarns 14.

In the case of all shown embodiments it is preferable that the yarn withdrawal nozzle 17 as well as the balloon-breaking insert 22 are each designed as replaceable parts.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Yarn withdrawal device for open-end spinning arrangements, comprising:

a yarn withdrawal nozzle, which contains a curved contact surface for guiding yarn which is to be withdrawn and which yarn simultaneously rotates in a crank-like manner, said contact surface graduating from a front surface into an axial channel, a balloon-breaking insert which extends said axial channel, an inner wall of the balloon-breaking insert being provided with raised areas/and or recesses with which the yarn comes into contact, and a channel section between the yarn withdrawal nozzle and the balloon-breaking insert, wherein the contact surface of the yarn withdrawal nozzle is a smooth steel surface, wherein an inner diameter of the channel section is smaller than a smallest inner diameter of the balloon-breaking section, and wherein the inner wall of the balloon-breaking insert is provided with blunted raised areas and/or recesses in such a way that a hairiness of the yarn is achieved in the range of 3 mm, while at the same time values regarding the spinning stability, tear-resistance and evenness of the yarn are achieved as is normally the case with notched contact surfaces of standard yarn withdrawal nozzles without balloon-breaking inserts.

2. Yarn withdrawal device according to claim 1, wherein the balloon-breaking insert is made of ceramic material at least on its inner wall.

3. Yarn withdrawal device according to claim 1, wherein a diameter contraction is provided between the axial channel of the yarn withdrawal nozzle and the balloon-breaking insert.

4. Yarn withdrawal device according to claim 2, wherein a diameter contraction is provided between the axial channel of the yarn withdrawal nozzle and the balloon-breaking insert.

5. Yarn withdrawal device according to claim 3, wherein the diameter contraction is provided in a separate intermediate ring.

6. Yarn withdrawal device according to claim 4, wherein the diameter contraction is provided in a separate intermediate ring.

7. Yarn withdrawal device according to claim 1, wherein a centering device is provided downstream of the balloon-breaking insert which permits a centered yarn withdrawal.

8. Yarn withdrawal device according to claim 7, wherein the centering device is formed by a diameter contraction.

9. Yarn withdrawal device for open-end spinning arrangements, comprising:

a yarn withdrawal nozzle, which contains a curved contact surface for guiding yarn which is to be withdrawn and which yarn simultaneously rotates in a crank-like manner, said contact surface graduating from a front surface into an axial channel, and a balloon-breaking insert which extends said axial channel, an inner wall of the balloon-breaking insert being provided with raised areas/and or recesses with which the yarn comes into contact, wherein the contact surface of the yarn withdrawal nozzle is a smooth steel surface, wherein the inner wall of the balloon-breaking insert is provided with blunted raised areas and/or recesses in such a way that a hairiness of the yarn is achieved in the range of 3 mm, while at the same time values regarding the spinning stability, tear-resistance and evenness of the yarn are achieved as is normally the case with notched contact surfaces of standard yarn withdrawal nozzles without balloon-breaking inserts, wherein a centering device is provided downstream of the balloon-breaking insert which permits a centered yarn withdrawal, wherein the centering device is formed by a diameter contraction, and wherein the diameter contraction is provided in a separate centering ring.

10. Yarn withdrawal device according to claim 2, wherein a centering device is provided downstream of the balloon-breaking insert which permits a centered yarn withdrawal.

11. Yarn withdrawal device according to claim 10, wherein the centering device is formed by a diameter contraction.

12. Yarn withdrawal device for open-end spinning arrangements, comprising:

a yarn withdrawal nozzle, which contains a curved contact surface for guiding yarn which is to be withdrawn and which yarn simultaneously rotates in a crank-like manner, said contact surface graduating from a front surface into an axial channel, and a balloon-breaking insert which extends said axial channel, an inner wall of the balloon-breaking insert being provided with raised areas/and or recesses with which the yarn comes into contact, wherein the contact surface of the yarn withdrawal nozzle is a smooth steel surface, wherein the inner wall of the balloon-breaking insert is provided with blunted raised areas and/or recesses in such a way that a hairiness of the yarn is achieved in the range of 3 mm, while at the same time values regarding the spinning stability, tear-resistance and evenness of the yarn are achieved as is normally the case with notched contact surfaces of standard yarn withdrawal nozzles without balloon-breaking inserts, wherein a centering device is provided downstream of the balloon-breaking insert which permits a centered yarn withdrawal, wherein the centering device is formed by a diameter contraction, and wherein the diameter contraction is provided in a separate centering ring.

13. Yarn withdrawal device according to claim 3, wherein a centering device is provided downstream of the balloon-breaking insert which permits a centered yarn withdrawal.

14. Yarn withdrawal device according to claim 13, wherein the centering device is formed by a diameter contraction.

15. Yarn withdrawal device for open-end spinning arrangements, comprising:

a yarn withdrawal nozzle, which contains a curved contact surface for guiding yarn which is to be withdrawn and which yarn simultaneously rotates in a crank-like manner, said contact surface graduating from a front surface into an axial channel, and a balloon-breaking insert which extends said axial channel, an inner wall of the balloon-breaking insert being provided with raised areas/and or recesses with which the yarn comes into contact, wherein the contact surface of the yarn withdrawal nozzle is a smooth steel surface, wherein the inner wall of the balloon-breaking insert is provided with blunted raised areas and/or recesses in such a way that a hairiness of the yarn is achieved in the range of 3 mm, while at the same time values regarding the spinning stability, tear-resistance and evenness of the yarn are achieved as is normally the case with notched contact surfaces of standard yarn withdrawal nozzles without balloon-breaking inserts, wherein a centering device is provided downstream of the balloon-breaking insert which permits a centered yarn withdrawal, wherein the centering device is formed by a diameter contraction, and wherein the diameter contraction is provided in a separate centering ring.

16. Yarn withdrawal device according to claim 15, wherein the centering device is formed by a yarn deflecting wall of a yarn withdrawal channel.

17. Yarn withdrawal device according to claim 1, wherein the balloon-breaking insert has raised areas formed by ribs or the like.

18. Yarn withdrawal device according to claim 1, wherein the balloon-breaking insert has recesses formed by notches or the like.

19. Yarn withdrawal device according to claim 1, wherein at least one of the yarn withdrawal nozzle and the balloon-breaking insert are designed as replaceable parts.

20. Yarn withdrawal device according to claim 19, wherein the yarn withdrawal nozzle is designed as a replaceable part.

21. Yarn withdrawal device according to claim 19, wherein the balloon-breaking insert is designed as a replaceable part.

22. Yarn withdrawal device according to claim 20, wherein the balloon-breaking insert is designed as a replaceable part.

23. A method of making yarn comprising the steps of:

providing a spinning yarn, a rotor open end spinning unit, a yarn withdrawal device comprising:

a yarn withdrawal nozzle, which contains a curved contact surface for guiding yarn which is to be withdrawn and which yarn simultaneously rotates in a crank-like manner, said contact surface graduating from a front surface into an axial channel and being a smooth steel surface, and a balloon-breaking insert which extends said axial channel, an inner wall of the balloon-breaking insert being provided with raised areas and/or recesses with which the yarn comes into contact in such a way that a hairiness of the yarn is achieved in the range of 2 to 4 mm, while at the same time values regarding the spinning stability, tear-resistance and evenness of the yarn are achieved as is normally the case with notched contact surfaces of standard yarn withdrawal nozzles without balloon-breaking inserts, a channel section between the yarn withdrawal nozzle and the balloon-breaking insert, wherein an inner diameter of the channel section is smaller than a smallest inner diameter of the balloon-breaking section, and withdrawing the yarn from a rotor of said spinning unit by way of the yarn withdrawal device.

24. Yarn withdrawal device for open-end spinning arrangements, comprising:

a yarn withdrawal nozzle, which contains a curved contact surface for guiding yarn which is to be withdrawn and which yarn simultaneously rotates in a crank-like manner, said contact surface graduating from a front surface into an axial channel, a balloon-breaking insert which extends said axial channel, an inner wall of the balloon-breaking insert being provided with raised areas/and or recesses with which the yarn comes into contact, and wherein the contact surface of the yarn withdrawal nozzle is a smooth steel surface, wherein an inner diameter of an exit region of the yarn withdrawal nozzle is larger than a largest inner diameter of the balloon-breaking section, and wherein the inner wall of the balloon-breaking insert is provided with blunted raised areas and/or recesses in such a way that a hairiness of the yarn is achieved in the range of 3 mm, while at the same time values regarding the spinning stability, tear-resistance and evenness of the yarn are achieved as is normally the case with notched contact surfaces of standard yarn withdrawal nozzles without balloon-breaking inserts.

* * * * *